US006084489A

United States Patent [19]

Castonguay et al.

[11] Patent Number: 6,084,489

[45] Date of Patent: Jul. 4, 2000

[54] CIRCUIT BREAKER ROTARY CONTACT ASSEMBLY LOCKING SYSTEM

[75] Inventors: Roger N. Castonguay, Terryville; Dean A. Robarge, Southington; Dave S. Christensen, Sandy Hook, all of Conn.

[73] Assignee: General Electric Company, Schenectady, N.Y.

[21] Appl. No.: 09/150,072

[22] Filed: Sep. 8, 1998

[51] Int. Cl.[7] ..... H01H 9/20

[52] U.S. Cl. ..... 335/167; 335/16; 218/22

[58] Field of Search ..... 335/16, 147, 195, 335/8–10, 167–176; 218/22, 27, 30

[56] References Cited

U.S. PATENT DOCUMENTS

| | | | |
|---|---|---|---|
| 4,144,513 | 3/1979 | Shaffer et al. . | |
| 4,220,934 | 9/1980 | Wafer et al. . | |
| 4,255,732 | 3/1981 | Wafer et al. . | |
| 4,259,651 | 3/1981 | Yamat . | |
| 4,263,492 | 4/1981 | Maier et al. . | |
| 4,409,573 | 10/1983 | Di Marco et al. . | |
| 4,488,133 | 12/1984 | McClellan et al. . | |
| 4,562,419 | 12/1985 | Preuss et al. . | |
| 4,608,545 | 8/1986 | Kralik | 335/16 |
| 4,611,187 | 9/1986 | Banfi . | |
| 4,612,430 | 9/1986 | Sloan et al. . | |
| 4,642,431 | 2/1987 | Tedesco et al. . | |
| 4,916,421 | 4/1990 | Pardini et al. | 335/185 |
| 5,029,301 | 7/1991 | Nebon et al. . | |
| 5,030,804 | 7/1991 | Abri | 200/323 |
| 5,310,971 | 5/1994 | Vial et al. | 218/154 |

*Primary Examiner*—Lincoln Donovan
*Attorney, Agent, or Firm*—Carl B. Horton; Dave S. Christensen

[57] ABSTRACT

The circuit breaker is characterized by separable contacts operable between a closed and an open position a contact arm having a latching surface and a latch arranged to engage the latching surface when the contacts are blown-open under short-circuit conditions. The arrangement of the latch allows for a positive lock under high magnitude short circuit levels while minimizing the force required by a mechanism to unlock the arm.

25 Claims, 7 Drawing Sheets

BLOWN-OPEN LATCHED POSITION

CIRCUIT BREAKER ROTARY CONTACT ASSEMBLY LOCKING SYSTEM

FIELD OF INVENTION

The present invention is directed to a circuit breaker having rotary contact assembly. The rotary contact system has a locking arrangement for locking the contact arm open under an occurrence of a large over current condition.

BACKGROUND OF THE INVENTION

The present invention relates to a current limiting molded case circuit breaker (MCCB) comprising a rotary contact assembly having single or plurality of contact arms. Circuit breakers of this type are commonly used to protect electrical systems whenever abnormalities occur in the system and are well known in the art. These types of breakers utilize a magnetic repulsion force generated between the stationary and moveable contacts during a short-circuit condition to quickly open the circuit breaker contact arms and separate the stationary and moveable contacts. This separation of the contacts interrupts the current flow through the circuit. One problem often encountered with this type of arrangement is that the contact arm may develop a high velocity due to the large magnetic forces, thus causing it to rebound off the contact arm stop surface. Unless this rebounding is taken into consideration, the contact arm will reclose and allow high levels of current to flow once again into the system. This reclosing action also releases a large amount of energy which often damages the circuit breaker. Accordingly, circuit breakers of this type usually employ some means of preventing the contact arm from reclosing.

U.S. patent application Ser. No. 09/108,684, filed Jun. 25, 1998, entitled "Rotary Contact Assembly for High Ampere Rated Circuit Breaker" assigned to the same assignee as the present invention describes a rotary type contact assembly using a spring-loaded roller-cam arrangement to lock the contact arm open. In this system, a roller rides along a cam surface on the contact arm and as the contact arm opens under high short circuit conditions the roller follows the cam into a recess in the contact arm. When the roller engages the recess, the contact arm is locked open and prevented from reclosing.

U.S. Pat. No. 5,310,971 entitled "Molded Case Circuit Breaker with Contact Bridge Slowed Down at the End of Repulsion Travel" describes a current limiting rotary type MCCB contact assembly using a spring-loaded pin and cam arrangement to slow the velocity of the contact arm. As the contact arm rotates under magnetic repulsion forces, the energy of the contact arm is absorbed by the springs slowing down the contact arm. When the contact arm reaches it's fully open position, the profile of the cam is such that the contact arm is locked open.

Other examples of current limiting molded case circuit breakers employing contact arm anti-rebound mechanisms can be found in U.S. Pat. No. 5,029,301 entitled "Limiting Circuit Breaker Equipped with an Electromagnetic Effect Contact Fall Delay Device", U.S. Pat. No. 4,263,492 "Circuit Breaker with Anti-Rebound Mechanism", and U.S. Pat. No. 4,611,187 "Circuit Breaker Contact Arm Latch Mechanism for Eliminating Contact Bounce".

Typically, such circuit breakers have a mechanism that under normal usage acts as actuation switch to open the contacts and interrupt the circuit. Under abnormal usage, such as when an over current condition is detected, the mechanism is automatically activated by actuation means well known in the art. This activation creates the necessary opening between the stationary and movable contacts and thus interrupts the current flow. This action of operating the mechanism is inherently slow. As was described above, in current-limiting circuit breakers, the contact arm is allowed to open under the magnetic repulsion forces generated during a short-circuit condition. This repulsion action is independent of the slower methods of opening described above, thus the contact arm opens much faster than the mechanism and it is likely that the contact arm will be locked open before the mechanism has had a chance to react. This situation places the contact arm and rotor/mechanism assemblies in two different positions. Before the circuit breaker can be reset and operated again, the contact arms must be unlocked and allowed to rotate into their normal position with respect to the rest of the assembly.

The typical method for accomplishing this is to use the tripping action of the mechanism associated with automatic actuation. The forces developed by the mechanism are used to unlock the contact arms. In the systems described above, the ability of the lock to operate and stop the rebounding of the arm is proportional to the force developed by the combination of the spring and the cam. Failure to develop a large enough locking force at very high level short circuits will result in the contact arm reclosing. While it is easy to develop an arrangement for producing these large locking forces, there is a limit to how much force the mechanism can produce to unlock the contact arm. Given the size constraints of molded case circuit breakers it is often the mechanism that is the limiting factor in determining at which short circuit level the contact arm will remain locked.

Accordingly, it is considered desirable to have a contact arm locking arrangement that provides a positive lock to prevent contact arm reclosure at any short-circuit level.

It is also desirable to describe a contact arm locking arrangement that where the force required to unlock the contact arm is independent of the force required to lock the arm.

It is also desirable to describe contact arm locking arrangement that allows the contact arm to open as fast as possible while providing a positive locking arrangement which prevents reclosure of the contact arm under high level short circuit conditions.

It is also desirable to provide arrangement for a contact arm locking system for circuit breakers such as those used industrial applications or other applications requiring the protection high amperage circuits.

SUMMARY OF INVENTION

In accordance with the present invention a circuit breaker contact assembly is provided that comprises a rotor having a rotor aperture through a central portion thereof. A movable contact arm is mounted for rotation to the rotor, the contact arm has at least one movable contact arranged thereon and has a first dwell surface and a locking surface thereon. A locking member is mounted for rotation proximate to the rotor having a catch surface. A spring member is mounted proximate to the locking member to bias the locking member catch surface against the contact arm first dwell surface.

Also in accordance with the present invention, a circuit breaker is provided having a case and cover. A rotor assembly within the case interconnecting with an operating mechanism and a movable contact arm having a first movable contact at one end and a second movable contact at an opposite end thereof. The rotor assembly is movable between a closed position, wherein the first and second movable contacts are engaged with a respective first and second stationary contacts, and an open position where the first and second movable contacts are separated from said first and second stationary contacts respectively. The contact arm has a first dwell surface and a locking surface thereon. A locking member within the case is mounted proximate to the rotor assembly and having a catch surface. A spring is mounted within the case proximate to the locking member for biasing the locking member such that the catch surface engages the contact arm first dwell surface.

DESCRIPTION OF THE PREFERRED EMBODIMENT

Figure 1:
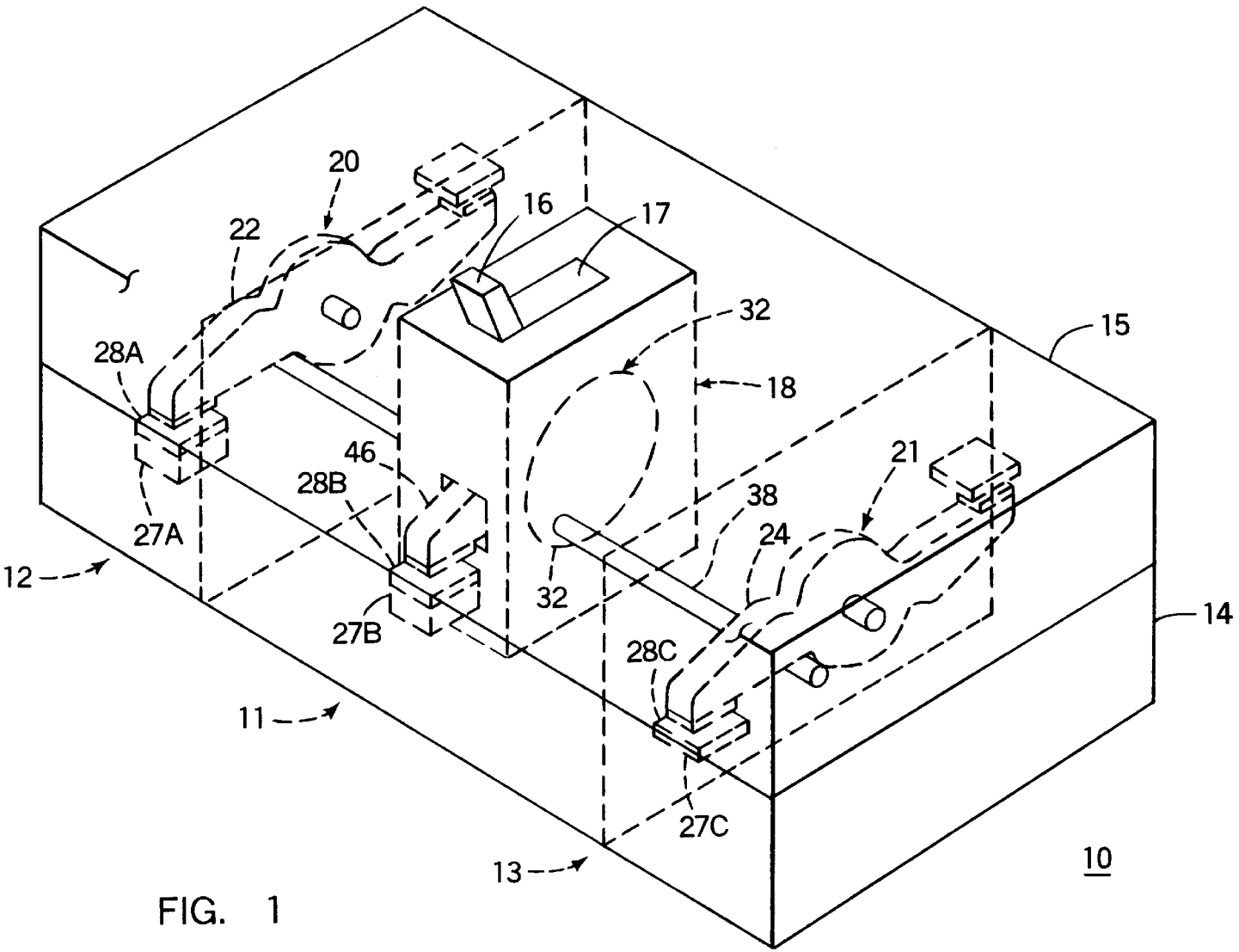
FIG. 1 is a top perspective view of a circuit breaker employing a rotary contact assembly in according to the invention.

A multipole circuit breaker 10 is shown in FIG. 1 consisting of a case 14 and a cover 15 with an operating handle 16 projecting from the cover through an aperture 17. The operating handle 16 interacts with the circuit breaker operating mechanism 18 to control the ON and OFF positions of the central rotary contact arm 46, and central rotary contact arm assembly 32 within the circuit breaker operating mechanism 18. A first rotary contact arm 22 and first rotary contact arm assembly 20 within a first pole 12, on one side of the operating mechanism 18 within the central pole 11, and a second rotary contact arm 24 and secondary contact arm assembly 21 within a second pole 13 on the opposite side of the central pole 11, move in unison to provide complete multi-pole circuit interruption. An elongated pin 38 interconnects the operating mechanism 18 with the first and second rotary contact arm assemblies 20, 21. As described in U.S. Pat. No. 4,649,247 entitled "Contact Assembly for Low-voltage Circuit Breakers with a Two-Arm Contact Lever", a rotor 44 interconnects each of the rotary contact arms 22,24,46 with the corresponding pairs affixed contact 27(A–C) and movable contacts 28(A–C).

Figure 2:
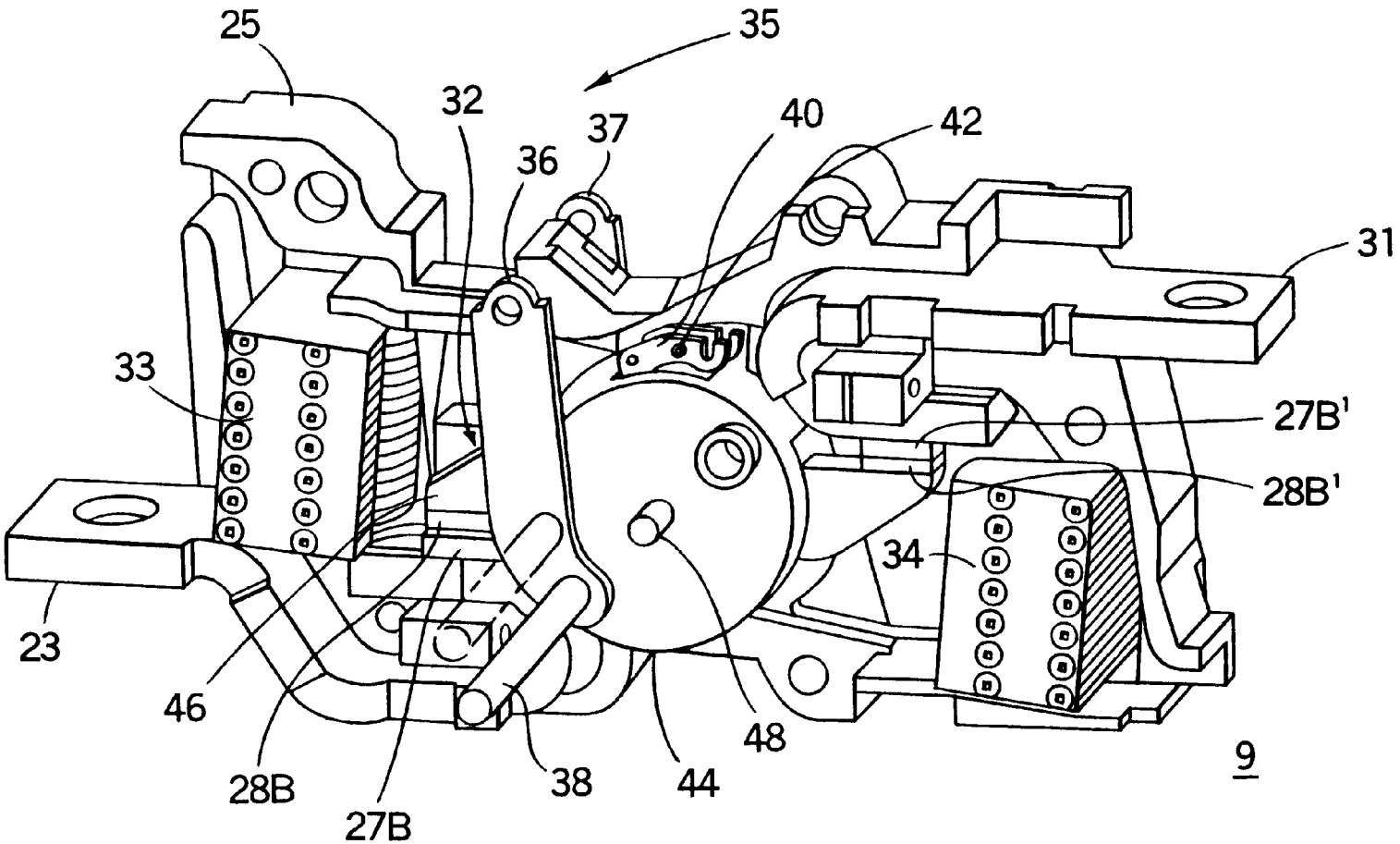
FIG. 2 is a top perspective view of the complete contact assembly contained within the circuit breaker of FIG. 1.
Figure 4:
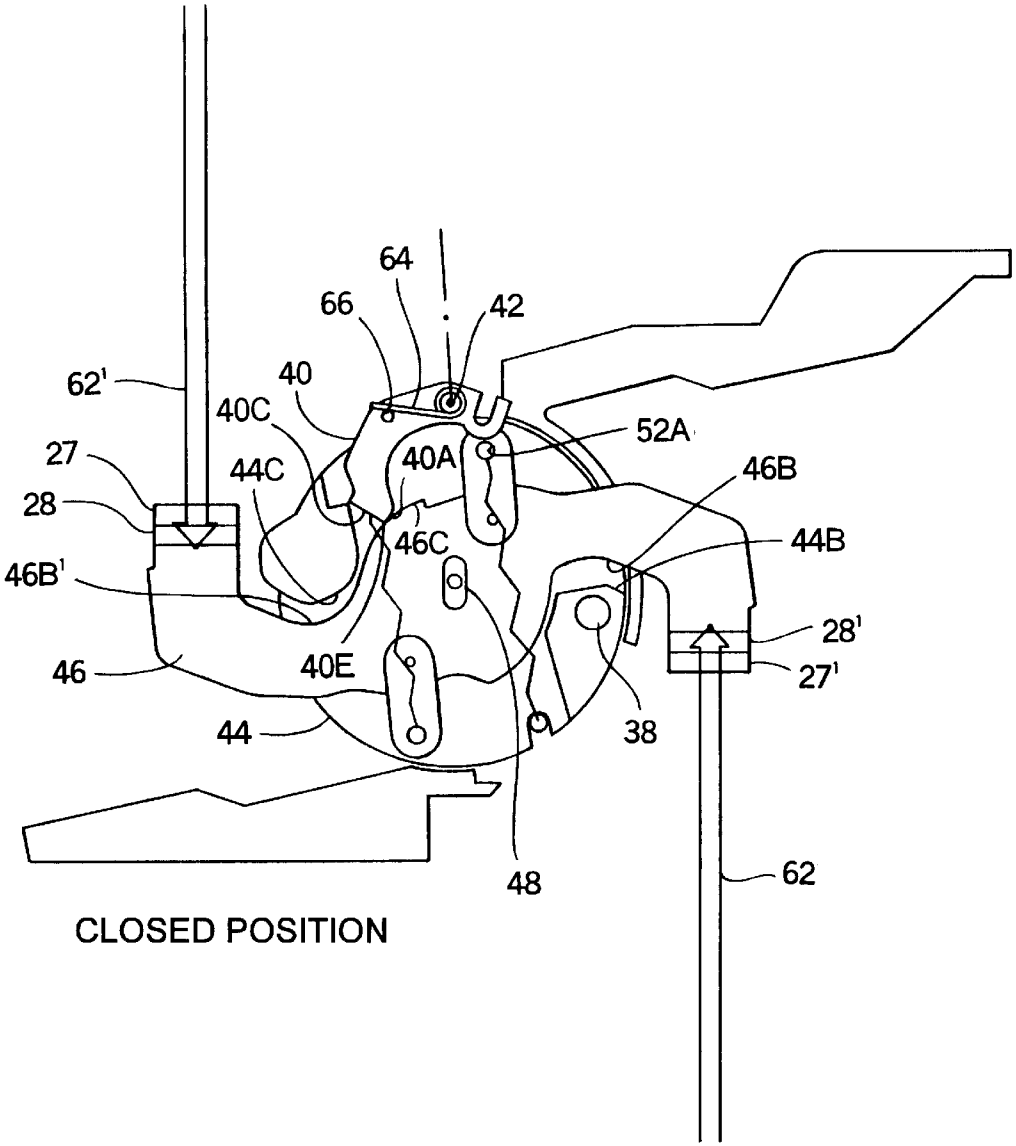
FIG. 4 is an enlarged front plan view of the rotary contact arm assembly according to the invention with the contacts in the CLOSED position.

The operation of the rotor assembly 32 in the circuit breaker assembly 9 as shown in FIG. 2 operates substantially the same as that described in co-pending U.S. patent application Ser. No. 09/087,038 filed May 29, 1998 which is incorporated herein by reference. As shown in FIG. 2, the rotor 44 is intermediate the line strap 23 and load strap 31 and the associated arc chutes 33,34. The first rotary contact arm assembly 20 and second rotary contact assembly 21 of FIG. 1 are not shown herein but are mirror images of the central rotary contact arm assembly 32 and operate in a similar manner. The arc chutes 33,34 are similar to that described within U.S. Pat. No. 4,375,021 entitled "Rapid Arc Extinguishing Assembly in Circuit Breaking Devices Such as Electric Circuit Breakers". The central rotary contact arm 46 moves in unison with the rotor 44 that, in turn, connects with the circuit breaker operating mechanism 18 of FIG. 1 by means of the elongated pin 38 to move the moveable contacts 28(A–C) between the CLOSED position depicted in FIG. 4 and the OPEN position depicted in FIG. 7. The clevis 35 consisting of the extending sidearms 36, 37 attach the rotor assembly 32 with the circuit breaker operating mechanism 18 and the operating handle 16 of FIG. 1 to allow both automatic as well as manual intervention for opening and closing the circuit breaker contacts 27(A–C) and 28(A–C). The rotor assembly 32 is positioned between the line and load straps 23,31 along with one of the contact pairs 27B,28B,27B',28B' to hold the contacts in close abutment to promote electrical transfer between the fixed and moveable contacts during normal circuit current conditions. The pivot pin 48 of the central rotary contact arm 46 extends through the rotor assembly 32. This pivot pin 48 can be supported either within the base 14 or alternately, into a modular cassette 25 that is contains the assembly 9. The operating pin 48 responds to the rotational movement of the rotor 44 to effect the contact closing and opening function. A latch 40 pivots on a pin 42 which is attached to the base 14, cover 15 or modular cassette 25. The purpose of the latch 40 will be made clearer herein.

Figure 3:
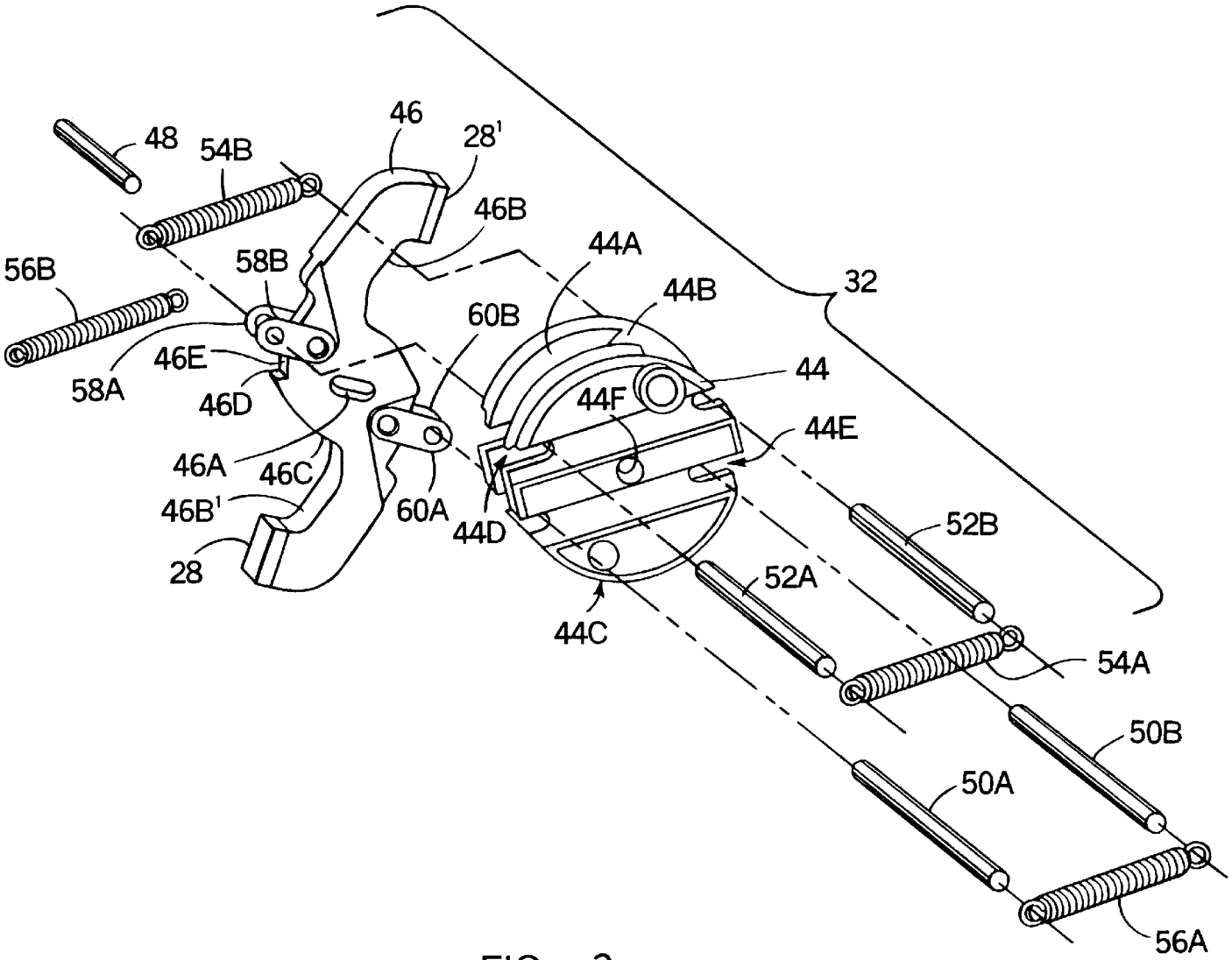
FIG. 3 is an enlarged top perspective view of the rotor in isometric projection with the contact arm assembly of FIG. 2.

As is best seen in FIG. 3, the rotor assembly 32 consists of a rotor 44 having a contact arm 46 extending through a central opening 44A in the rotor 44. The contact arm 46 is attached to the rotor 44 by a pivot pin 48 which extends through a central aperture 46A in the contact arm 46 and a central aperture 44F in the rotor 44. As is described in the aforementioned U.S. patent application Ser. No. 09/087,038, filed May 29, 1998, two pairs of springs 54A/54B, 56A/56B are attached to the rotor 44 by pins 50A,52B and to the links 58A/58B, 60A/60B by the linkage pins 50B,52A. The two pairs of springs 54A/54B, 56A/56B act to apply load to the contact arm 46 via the links 58A/58B, 60A/60B. This load tends to force the contact arm surfaces 46B, 46B' into contact with the rotor stop surfaces 44B, 44C respectively. Rotor stop surface 44C is not shown in FIG. 3 for purposes of clarity.

In normal operation when the mechanism rotates the rotor assembly 32 into the CLOSED position the movable contacts 28 contact the stationary contacts 27 shown in FIG. 1. The mechanism continues to rotate the rotor 44 until the rotor assembly reaches its fully closed position shown in FIG. 4. When in the fully CLOSED position, a gap is formed between the stop surfaces 44B, 44C and the contact arm surfaces 46B, 46B'. This gap results in the spring pairs 54A/54B, 56A/56B being stretched to provide contact pressure between the movable and stationary contacts 27,28. A spring 64 applies a force against a pin 66, which attached to the latch 40, biasing the latch 40 such that an edge 40E formed between the latch catch surface 40C and latch surface 40A rests against a dwell surface 46C on the contact arm 46.

Figure 5:
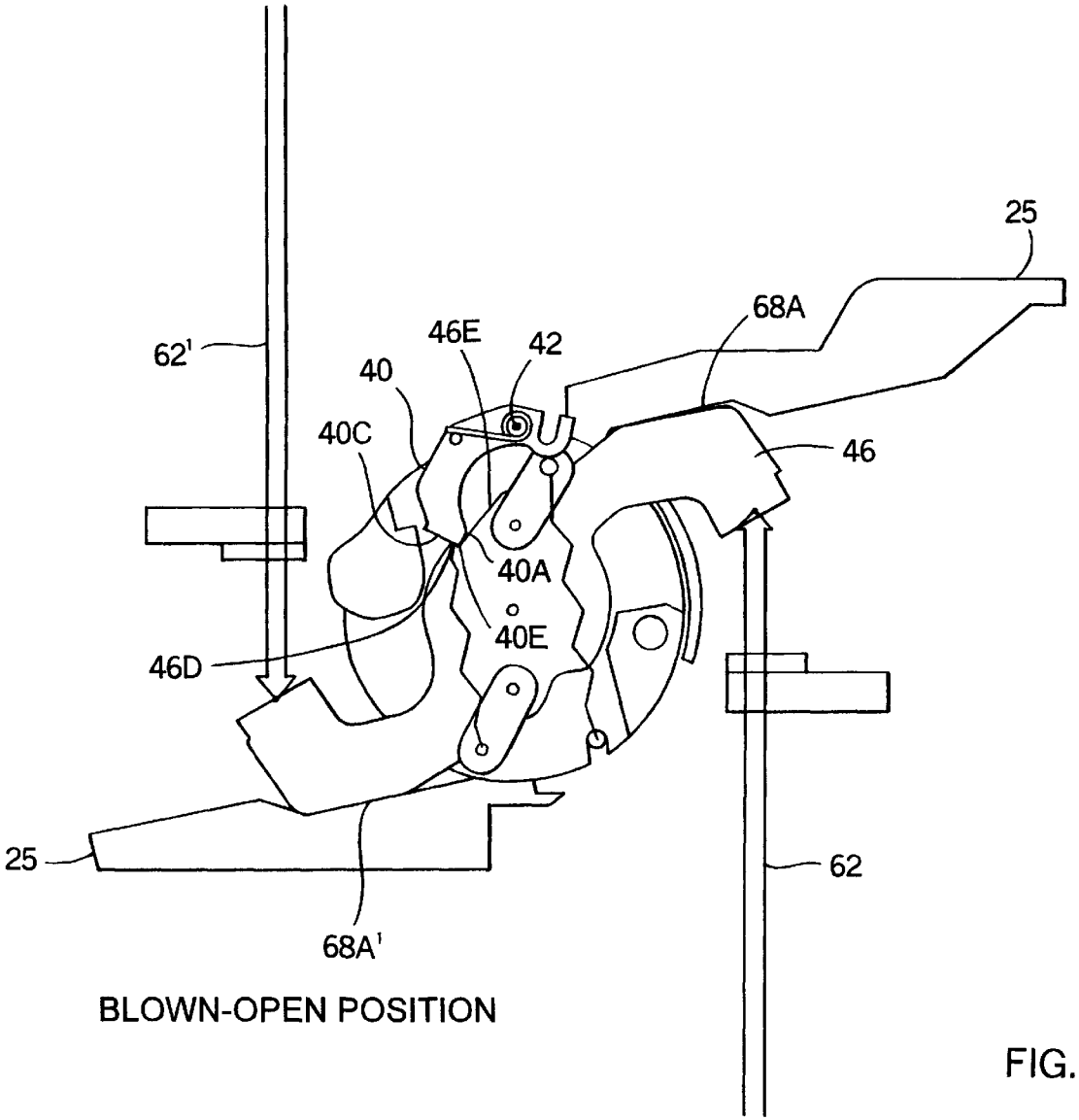
FIG. 5 is an enlarged front plan view of the rotary contact arm assembly according to the invention with the contacts in the BLOWN-OPEN position.

Under the occurrence of a large overcurrent or short-circuit condition, a magnetic repulsion force 62,62' generated between the movable and stationary contacts 27, 28 is applied such that it drives the contact arm 46 counter-clockwise about the pivot pin 48. The contact arm 46 will continue to rotate (FIG. 5) until it contacts the stop surfaces 68A, 68A' in the case 14 and cover 15, or the modular cassette 25 as shown. As the contact arm 46 rotates, the latch edge 40E under the bias of spring 64 will drop into contact with the surface 46E. The spring 64 only needs to provide enough force to keep the latch 40 in contact with the contact arm 46. This allows the use of a relatively weak spring regardless of the magnitude of the overcurrent condition. As will be further discussed below, use of the weak spring will aid in the resetting of the locked contact arm 46.

Figure 6:
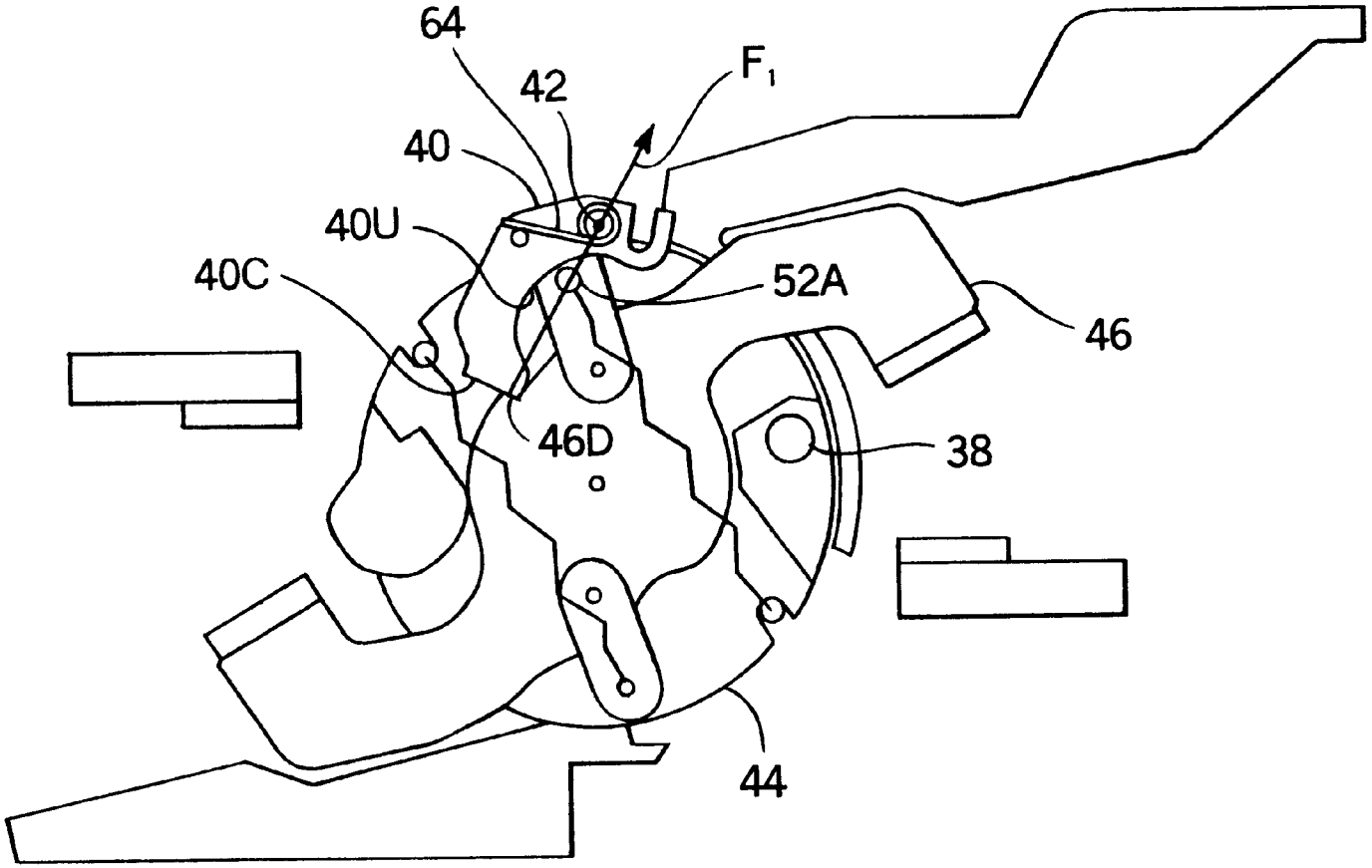
FIG. 6 is an enlarged front plan view of the rotary contact arm assembly according to the invention with the contacts in the BLOWN-OPEN-LATCHED position.

Owing to the large magnetic repulsion forces 62,62', the contact arm 46 will rebound off the stop surfaces 68A, 68A' and start to reclose. This reversal of rotation by the contact arm will result in the latch catch surface 40C contacting the contact arm latching surface 46D. This contact stops the reverse rotation of the contact arm 46 and creates a positive lock of the contact arm 46 in the blown-open latched position as is shown in FIG. 6. Since the line of action for the contact force $F_1$ goes through the pin 42 no moment will be generated to bounce the latch 40 out of contact with the contact arm 46. This arrangement allows for the latch 40 to remain locked regardless of the magnitude of the magnetic repulsion forces. It should be appreciated that the latch catch surface 40C and contact arm locking surface 46D could be arranged such that if the line of action of force $F_1$ is slightly to the right (as oriented in FIG. 6) of pin 42, a moment will be generated about the latch 40 pivot which would tend to further bias the latch 40 into contact with the contact arm 46. It may be desirable to generate this moment in cases where manufacturing tolerance stackup does not ensure that the force $F_1$ will go through the center of the pin 42.

FIG. 6 shows the catch arm in it's blown-open latched position. A short time after the contact arm 46 blows open, typically 0.004 to 0.012 seconds, the circuit breaker mechanism will react to rotate the rotor 44 to the OPEN position. As described above, this is accomplished when the clevis sidearms 36, 37 pull on the pin 38 causing the rotor 44 to rotate counterclockwise. As this rotation occurs, the linkage pin 52A will rotate with the rotor 44 and approach the latch surface 40U.

Figure 7:
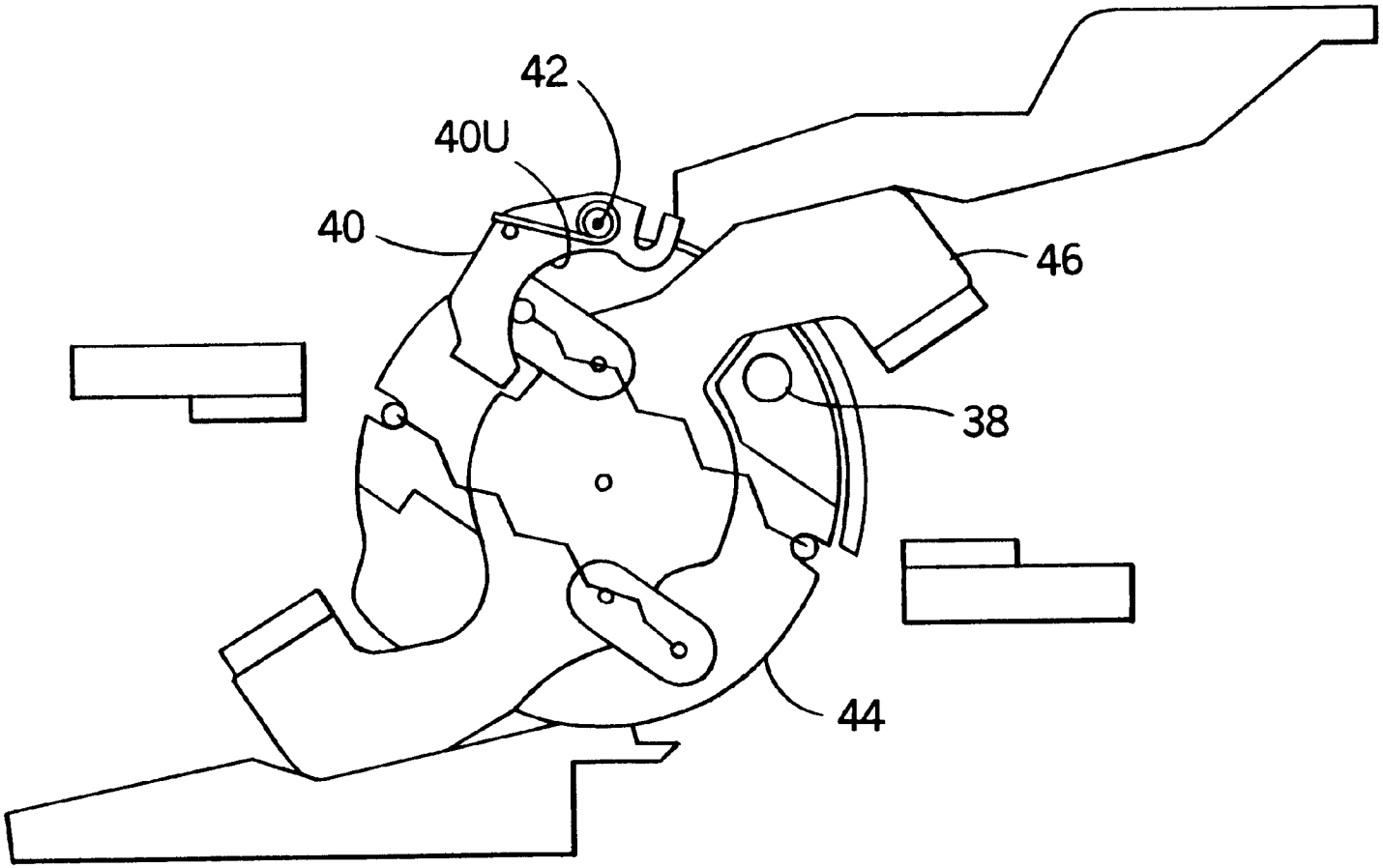
FIG. 7 is an enlarged front plan view of the rotary contact arm assembly according to the invention with the contacts in the OPEN position.

As is seen in FIG. 7, as the rotor 44 continues to rotate, the pin 52A contacts the latch surface 40U and causes the latch 40 to rotate away from the contact arm 46. This action releases the contact arm 46 and allows the rotor assembly 32 to reset to its normal position. Depending on the position of the rotor when the contact arm is released the tension in the two pairs of springs 54A/54B, 56A/56B will act to quickly rotate the rotor 44 into the normal reset position.

Although a preferred embodiment of this invention has been described, many variations and modifications will now be apparent to those skilled in the art, and it is therefore preferred that the instant invention be limited not by the specific disclosure herein but only by the following claims.

We claim:

1. A circuit breaker comprising:

a case and cover;

a cassette mounted within said case and cover;

a rotor assembly within said cassette interconnecting with an operating mechanism and a movable contact arm having a first movable contact at one end and a second movable contact at an opposite end thereof, said rotor assembly being movable between a closed position, wherein said first and second movable contacts are engaged with a respective first and second stationary contacts, and an open position where said first and second movable contacts are separated from said first and second stationary contacts respectively, said contact arm having a first dwell surface and a locking surface thereon;

a latch member mounted to said cassette adjacent to said rotor assembly, said latch member having an edge;

a spring mounted within said cassette adjacent to said latch member, said spring biasing said latch member such that said latch edge engages the contact arm first dwell surface.

2. The circuit breaker of claim 1 wherein:

said contact arm is arranged to rotate to a blown-open-latched position intermediate said open and closed positions;

said latch member further comprises a catch surface adjacent to said edge, where said latch member catch surface engages with said contact arm latching surface when said contact arm rotates to said blown-open-latched position and;

said latch member is arranged such that the engagement of said latch member catch surface with said contact arm latching surface prevents said contact arm from rotating from the blown-open-latched position to the closed position.

3. The circuit breaker of claim 2 wherein said rotor assembly further comprises a pin, mounted to said rotor and positioned between said contact arm and said latch member.

4. The circuit breaker of claim 3 wherein said latch member further comprises an unlatching surface arranged such that said pin engages said unlatching surface as said rotor rotates from said rotor closed position to said rotor open position.

5. The circuit breaker of claim 4 wherein said pin cooperates with said unlatching surface to rotate said latch member catch surface out of contact with said contact arm.

6. The circuit breaker of claim 2 wherein said engagement of said latch member catch surface with said contact arm locking surface defines a line of extending approximately through a latch member axis of rotation.

7. The circuit breaker of claim 2 wherein said engagement of said latch member catch surface with said contact arm locking surface defines a line of force extending a finite distance from a latch member axis of rotation such that a moment is created about said latch member axis of rotation, said moment biasing said latch member into engagement with said contact arm.

8. A circuit breaker comprising:

a case and cover;

a cassette mounted within said case and cover;

a rotor assembly within said cassette interconnecting with an operating mechanism and a movable contact arm having a movable contact at one end and mounted for rotation to a rotor at an opposite end thereof, said rotor assembly being movable between a closed position, wherein said movable contact is engaged with a first stationary contact, and an open position where said movable contact is separated from said stationary contact, said contact arm having a first dwell surface and a locking surface thereon;

a latch member mounted for rotation within said cassette adjacent to said rotor assembly, said latch member having an edge;

a spring mounted within said case proximate to said latch member, said spring biasing said latch member such that said edge engages the contact arm first dwell surface.

9. The circuit breaker of claim 8 wherein:

said contact arm is arranged to rotate to a blown-open-latched position intermediate said open and closed positions;

said latch member further comprising a catch surface adjacent said edge such that said latch catch surface engages said contact arm latching surface when said contact arm rotates to said blown-open-latched position; and, said latch member is arranged such that the engagement of said latch member catch surface with said contact arm latching surface prevents said contact arm from rotating from the blown-open position to the closed position.

10. The circuit breaker of claim 9 wherein said rotor assembly further comprises a pin, mounted to said rotor positioned between said contact arm and said latch member.

11. The circuit breaker of claim 10 wherein said latch member further comprises an unlatching surface arranged such that said pin engages said unlatching surface as said rotor rotates from said rotor closed position to said rotor open position.

12. The circuit breaker of claim 11 wherein said pin cooperates with said unlatching surface to rotate said latch member catch surface out of contact with said contact arm.

13. The circuit breaker of claim 9 wherein said engagement of said latch member catch surface with said contact arm locking surface defines a line of force extending approximately through a latch member axis of rotation.

14. The circuit breaker of claim 9 wherein said engagement of said latch member catch surface with said contact arm latching surface defines a line of force extending a finite distance from a latch member axis of rotation such that a moment is created about said latch member axis of rotation, said moment biasing said latch member into engagement with said contact arm.

15. A circuit breaker contact assembly comprising:

a cassette;

a rotor within said cassette;

a movable contact arm pivotally mounted to said rotor, said contact arm having at least one movable contact arranged thereon and having a first dwell surface and a locking surface thereon;

a latch member pivotally mounted to said cassette adjacent to said contact arm, said latch member having an edge;

a spring member mounted to said cassette adjacent to said latch member, said spring biasing said latch member edge against said contact arm first dwell surface.

16. The contact assembly of claim 15, wherein said contact arm pivotal mounting consists of:

said rotor having a pivot axis extending therethrough;

said contact arm having a slot therethrough; and, a pivot pin, said pivot pin being mounted to said rotor and concentric with said rotor pivot axis, said pivot pin extending through said contact arm slot.

17. The contact assembly of claim 8 wherein:

said movable contact arm is arranged for rotation between a closed and a blown-open-latched position;

said latch member further comprises a catch surface adjacent said edge; and, said latch member catch surface rests against said contact arm first dwell surface when said contact arm is in a closed position and against said contact arm locking surface when said contact arm is in the blown-open-latched position.

18. The contact assembly of claim 17 wherein said movable contact arm further comprises a second dwell surface wherein said locking surface is intermediate said first and second dwell surfaces.

19. The contact assembly of claim 18 wherein:

said contact arm having an open position, said blown-open-latched position being intermediate said closed an open position;

said spring biases said latch member edge against said contact arm second dwell surface when said contact arms in the open position.

20. The contact assembly of claim 19 wherein a second pin mounted to said rotor, said second pin positioned between said contact arm and said latch member.

21. The contact assembly of claim 20 wherein:

said rotor is arranged rotate between a closed position and open position;

said latch member further comprises an unlatch surface arranged such that said second pin engages said unlatching surface as said rotor a case from said rotor closed position to said rotor open position.

22. The contact assembly of claim 21 wherein said second pin cooperates with said unlatching surface to rotate said latch member surface on contact with said contact arm.

23. The contact assembly of claim 19 wherein said latch member is arranged such that the engagement of said latch member catch surface with said contact arm latch surface prevents said contact arm rotating from the blown open latched position to the closed position.

24. The contact assembly of claim 23 wherein said engagement of said latch member catch surface with said contact arm latching surface defines a line of force extending approximately through a latch member axis of rotation.

25. The contact assembly of claim 23 wherein said engagement of said latch member catch surface with said contact arm latching surface defines a line of force extending a finite distance from a latch member axis of rotation such that a moment is created about said latch member axis of rotation, said moment biasing said latch member into engagement with said contact arm.

* * * * *